US006129212A

United States Patent [19]

Müller

[11] Patent Number: 6,129,212

[45] **Date of Patent: *Oct. 10, 2000**

[54] FLOTATION PROCESS AND MIXING DEVICE

[75] Inventor: Jens Müller, Appleton, Wis.

[73] Assignee: Voith Sulzer Stoffaufbereitung GmbH, Ravensburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/834,457

[22] Filed: Apr. 15, 1997

[30] Foreign Application Priority Data

Apr. 17, 1996 [DE] Germany ..... 196 15 089

[51] Int. Cl.[7] ..... B03D 1/24; B03D 1/14

[52] U.S. Cl. ..... 209/164; 209/170; 162/4; 210/221.2; 210/703

[58] Field of Search ..... 209/170, 164; 210/703, 221.2, 221.1; 261/DIG. 75; 162/4

[56] References Cited

U.S. PATENT DOCUMENTS

| | | |
|---|---|---|
| 3,371,779 | 3/1968 | Hollingsworth et al. . |
| 3,722,679 | 3/1973 | Logue . |
| 3,938,738 | 2/1976 | Nagel . |
| 4,490,259 | 12/1984 | Coffing . |
| 4,545,892 | 10/1985 | Cymbalisty . |
| 4,726,897 | 2/1988 | Schweiss et al. . |
| 5,350,511 | 9/1994 | Sakorada . |
| 5,463,176 | 10/1995 | Eckert . |
| 5,520,806 | 5/1996 | Menke . |
| 5,811,013 | 9/1998 | Ito . |

FOREIGN PATENT DOCUMENTS

| | | |
|---|---|---|
| 243690 | 11/1987 | European Pat. Off. . |
| 2156375 | 5/1973 | France . |
| 2256902 | 8/1975 | France . |
| 3401161 | 11/1985 | Germany . |
| 9404986 | 8/1994 | Germany . |
| 6-57669 | 3/1994 | Japan . |
| 6-128889 | 5/1994 | Japan . |
| 7-145585 | 6/1995 | Japan . |
| 1407281 | 9/1975 | United Kingdom . |
| 1545559 | 5/1979 | United Kingdom . |
| 2288995 | 11/1995 | United Kingdom . |

*Primary Examiner*—Thomas M. Lithgow
*Attorney, Agent, or Firm*—Greenblum & Bernstein, P.L.C.

[57] ABSTRACT

The flotation process for separating particulate impurities from fibrous suspensions in a flotation tank. Upon or after entry into the flotation tank, the fibrous suspension added to the flotation tank may be mixed with a portion of the suspension already in the flotation tank. The portion of the suspension already in the flotation tank may be drawn into the added suspension. After mixing, the mixed suspensions enter a mixing element. The mixed suspension is expelled into the flotation tank and a circular flow pattern is generated within the flotation tank as a result. A flow speed may be limited at a top end so that an optimal mixing with the gas bubbles required for flotation may occur with a desired energy savings.

28 Claims, 3 Drawing Sheets

Fig. 1
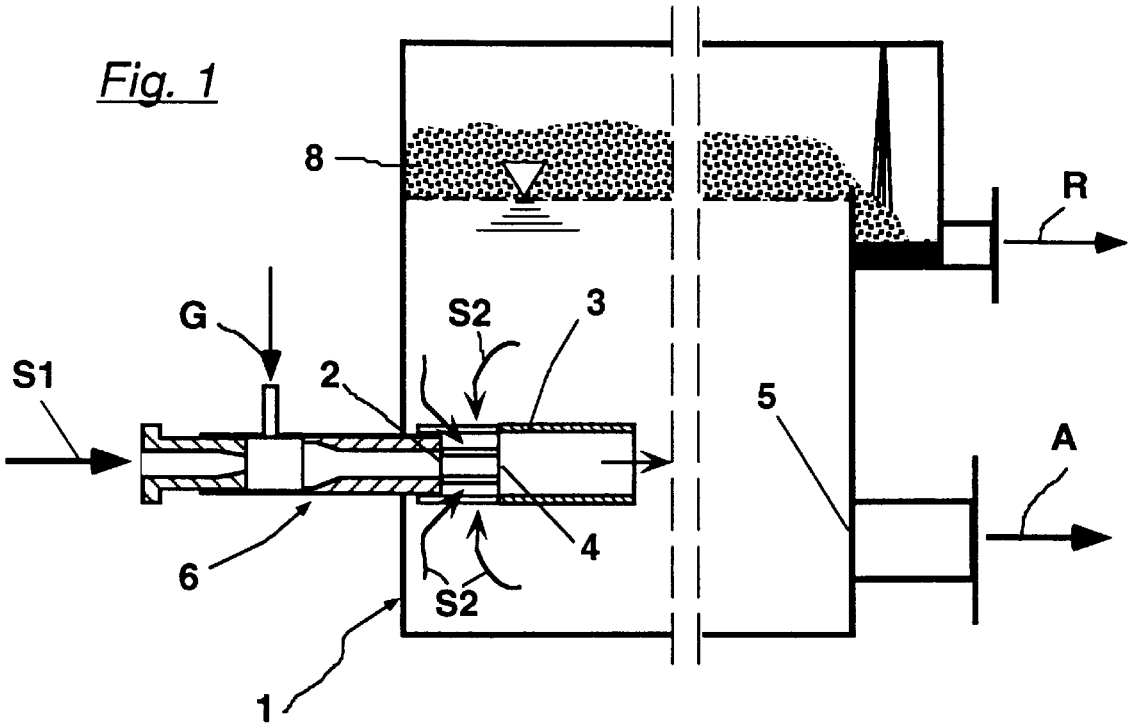
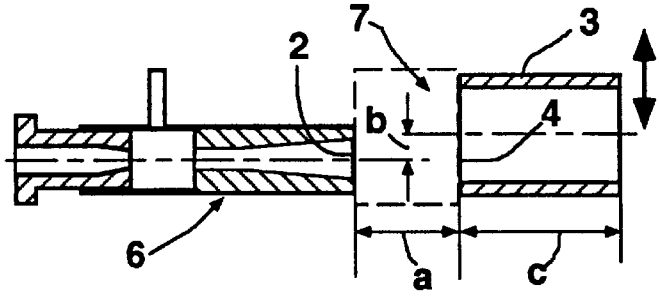
Fig. 2
Fig. 3
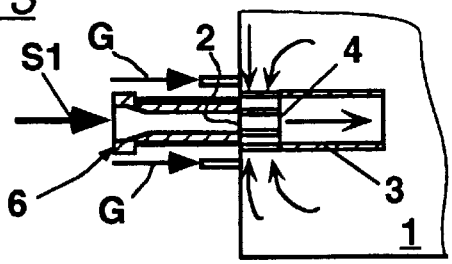

FLOTATION PROCESS AND MIXING DEVICE

CROSS REFERENCE TO RELATED APPLICATIONS

The present application claims priority under 35 U.S.C. §119 of German Patent Application No. DE 196 15 089.2, filed on Apr. 17, 1996, the disclosure of which is expressly incorporated herein by reference in its entirety.

BACKGROUND OF THE INVENTION

1. Field of the Invention

The present invention relates to a flotation process for separating solids from a paper stock-containing suspension may be introduced to a flotation tank through an inlet opening and a clarified accepted stock, e.g., a fibrous suspension free of foreign matter or clarified (or pure) water, may be conveyed out through an outlet opening. Due to the flotation process, at least a part of the solids present in the suspension may be concentrated in a foam collected on a surface and may be removed from the flotation tank. At least a predominant part of the suspension flowing into the flotation tank may be routed through a guiding element so that, before entry into the guiding element, the flowing suspension may aspirate a portion of the suspension already present in the flotation tank. Accordingly, the guiding of the flows occurs through the guiding element at a speed less than approximately 2 m/sec.

The present invention may also relate to a mixing device for carrying out the above-noted flotation process. The mixing device may include a mixing element having at least one inlet opening for introducing the paper stock-containing suspension into the flotation tank. Further, the mixing device may include at least one guiding element having at least one influx opening located downstream of the inlet opening and spaced a predetermined distance from the inlet opening. A collecting chamber may be positioned within the predetermined distance between the inlet opening and the influx opening.

2. Discussion of Background Information

Processes of the kind generally disclosed above have been discussed, e.g., in German patent publication 34 01 161. These processes are used in the paper industry for removal of printing inks, glues, or other interfering impurities during the processing of recycled paper. Due to their hydrophobic properties, the fibers in the suspension are removed as accepted stock, while the impurity solids are discarded with the foam. Because of this separation of solids into fibers and impurities, this process has been called selective flotation. Other uses for the general flotation process discussed above is in the removal of as large as possible a percentage of solids from a liquid suspension, e.g., in treatment of waste water produced by pressing in the paper industry. This process has been called clarifying flotation or, because of a gassing mechanism, decompression flotation.

As mentioned above, processes of this type have been in use for a long time and have a relatively high standard of effectiveness. Nevertheless, there is a demand for further improving the effectiveness of the flotation process.

SUMMARY OF THE INVENTION

An object of the present invention, therefore, may be to produce a flotation process having a better separation effect and/or a lower specific energy requirement. Thus, the present invention may achieve a more favorable purity of paper stock and/or a reduced fiber loss due to an increased removal of a quantity of undesirable components from the paper stock suspension.

The nature of momentum exchange in a region of a guiding element in a flotation device may be such that precisely a specified requisite dissipation of energy occurs to expedite taking up of hydrophobic particles by air bubbles. In this manner, the air bubbles may not be disadvantageously changed nor may the particles already taken up by the air bubbles be torn away again. Instead, a size of the air bubbles may be better influenced or regulated, if so desired, by the present invention. Specifically, producing a spectrum of air bubble sizes in accordance with certain requirements, particularly in fibrous suspensions, may be difficult or unstable when produced solely by conventional injectors. Conversely, an entire energy conversion may occur under particularly favorable conditions in accordance with the process of the present invention, in particular in comparison to the prior art injectors, because the speeds may be lower due to the larger volumes involved.

In accordance with the present invention, the suspension located within the flotation tank may be set in agitating motion due to an effective eddying generated in the flotation tank by the guiding element. Through this eddying, portions of the suspension within in the flotation tank may be repeatedly mixed with the fresh or new influx of highly gassed suspension. Thus, the recirculating motion within the flotation tank may increase a probability that solid particles, to be separated, may come into contact with the furnished air bubbles. A separating action of the flotation process may also improved as a result. Specifically, the above-described eddying effect may also be suited for removing turbulences occurring in the prior art, e.g., directly at the mouth of the inlet tube into the flotation tank. This turbulence impairs flotation and uses up unnecessary energy. However, if aspirated, in accordance with the present invention, its energy may be usefully employed for gassing and mixing.

Further, in accordance with the present invention, the agitating motion may be controlled so as not to harm the flotation. Thus, movement of gas bubbles relative to the surface may still occur in the required fashion due to locally limiting the agitation flow to a small portion of the suspension located within the flotation tank. Preferably, the suspension leaves the guiding element in a substantially horizontal direction, even when the inlet line is positioned vertically.

Accordingly, the present invention may be directed to a flotation process for separating solids from a suspension within a flotation tank by flotation. The flotation may produce clarified accepted stock and a foam collected on a surface of the suspension within the flotation tank. The flotation process may include introducing a suspension to the flotation tank through an inlet opening, guiding a portion of the suspension from the inlet opening to a guiding element, aspirating a portion of the suspension within the flotation tank, drawing the aspirated portion into the guiding element, and mixing the guided portion with the aspirated portion within the guiding element.

In accordance with another feature of the present invention, the process may also include regulating a flow of the guided portion and the aspirated portion through the guiding element of less than approximately 2 m/sec. Further, the process may also include regulating the flow through the guiding element of less than approximately 1 m/sec.

In accordance with another feature of the present invention, the process may also include positioning the guiding element within the flotation tank and spacing an influx opening of the guiding element a distance of less than approximately 1 m from the inlet opening.

In accordance with still another feature of the present invention, the process may also include maintaining a mixing volume within the guiding element less than approximately 5% of a suspension volume within the flotation tank.

In accordance with yet another feature of the present invention, the process may also include adjustably spacing an influx opening of the guiding element from the inlet opening.

In accordance with another feature of the present invention, the process may also include monitoring a flotation effect and actuating the spacing adjustment in accordance with the monitored flotation effect.

In accordance with a further feature of the present invention, the process may also include laterally adjusting, with respect to a flow direction of the guided portion, the guiding element relative to the inlet opening.

In accordance with still another feature of the present invention, the process may also include monitoring a flotation effect and actuating the lateral adjustment in accordance with the monitored flotation effect.

In accordance with another feature of the present invention, the process may also include positioning the inlet opening for a horizontal flow of the suspension into the flotation tank.

In accordance with yet another feature of the present invention, the process may also include positioning the inlet opening for a vertical flow of the suspension into the flotation tank. Further, the process may also include deflecting the suspension in the guiding element to flow substantially horizontally outward. Further, the process may also include deflecting the suspension to flow substantially horizontally outward through the inlet opening and through the guiding element.

In accordance with still another feature of the present invention, the process may also include adding gas bubbles to the suspension before the suspension emerges from the inlet opening.

In accordance with a still further feature of the present invention, the process may also include adding gas bubbles for flotation to the suspension, at least partially, in the guiding element. Alternatively, the process may also include adding gas bubbles for flotation, at least in part, directly in the flotation tank.

In accordance with a further feature of the present invention, the process may also include introducing a gas to the suspension before introducing the suspension to the flotation tank, exerting a pressure on the suspension with the gas, dissolving the gas in the suspension, reducing the pressure on the suspension, and producing gas bubbles for flotation through out the suspension.

In accordance with another feature of the present invention, the process may also include providing a volume of gas bubbles for flotation in the guiding element of less than approximately three times a suspension volume.

The present invention may also be directed to a mixing device for use in a flotation process in a flotation tank. The guiding device may include an inlet element having at least one inlet opening introducing the suspension into the flotation tank, a guiding device including at least one guiding element having at least one influx opening located downstream of the at least one inlet opening and a collecting chamber formed in a space between the at least one inlet opening and the at least one influx opening.

According to another feature of the present invention, the guiding element may include a flow conduit.

According to yet another feature of the present invention, a center of a flow cross-section of the at least one influx opening corresponding with a center of the inlet opening.

According to still another feature of the present invention, each of the at least one inlet opening and the at least one influx opening may include one of a circular or oval cross-section. Alternatively, each of the at least one inlet opening and the at least one influx opening may include substantially rectangular cross-sections.

According to a further feature of the present invention, the mixing element may provide a constant flow cross-section between 0.001 and 0.05 $m^2$.

According to a still further feature of the present invention, each of the at least one inlet opening and the at least one influx opening may include a cylindrical shape and the guiding device may be positioned to discharge an introduced suspension radially outward with respect to each of the at least one inlet opening and the at least one influx opening.

According to another feature of the present invention, the guiding element may include a length of between approximately 0.1 to 1 m in a direction of flow.

According to still another feature of the present invention, the mixing element may extend substantially vertically downward to the at the inlet opening, a flow cross-section of the at least one influx opening is positioned substantially horizontally, and the guiding element comprising a conduit to deflect an introduced suspension flow from a substantially vertical direction to a substantially horizontal direction. Further, the introduced suspension flow may be radially outward with respect to the mixing element.

According to yet another feature of the present invention, the at least one influx opening may be approximately 1.5 to 5 times larger than the at least one inlet opening.

The present invention may also be directed to a flotation process in a flotation tank in which a foam is formed on a surface of a suspension in the flotation tank. The flotation process may include guiding an input suspension through a mixing element having a predefined space, drawing a portion of the suspension in the flotation tank into the predefined space, and mixing the input suspension and the drawn in suspension.

According to another feature of the present invention, the process may also include creating a circular flow pattern within the suspension in the flotation tank.

According to another feature of the present invention, the process may also include guiding the input suspension in a substantially horizontal direction, with respect to the flotation tank and expelling the mixed input suspension and drawn in suspension in the substantially horizontal direction.

According to yet another feature of the present invention, the process may also include guiding the input suspension in a substantially vertical direction, with respect to the flotation tank, and expelling the mixed input suspension and drawn in suspension in a substantially horizontal direction. Further, the process may also include drawing the drawn in suspension into the substantially vertically guided input suspension. Alternatively, the process may also include deflecting the guided input suspension from the substantially vertical direction to a substantially horizontal direction and drawing the drawn in suspension into the substantially horizontally guided input suspension.

Further embodiments and advantages can be seen from the detailed description of the present invention and the accompanying figures.

BRIEF DESCRIPTION OF DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein:

FIG. 1 schematically illustrates a flotation apparatus and the process of the present invention;

FIG. 2 schematically illustrates a mixing device in accordance with the invention;

FIGS. 3 and 4 each illustrate an alternative embodiment of the present invention having altered flow routing;

DETAILED DESCRIPTION OF THE PREFERRED EMBODIMENTS

Figure 4:
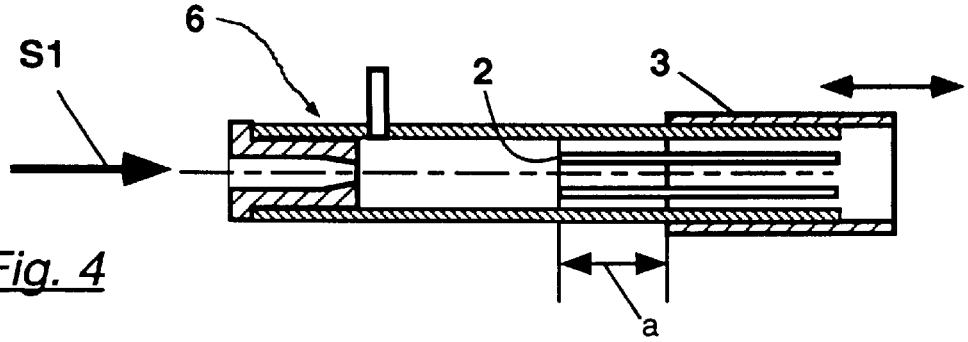

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

FIG. 1 schematically illustrates a flotation apparatus that may be utilized to discuss performing the process of the present invention. The flotation apparatus may include a flotation tank 1, which is only shown in part for the sake of clarity. When the process of the present invention is performed, flotation tank 1 may be predominantly filled with a suspension that has a foam 8 formed on its surface, which is known in the prior art. Foam 8 may contain an as large as possible collection of components that are to be floated out of the suspension. Foam 8 may be run off as rejected components R via, e.g., a foam weir. A paper stock-containing suspension S1 may travel (or be guided) into flotation tank 1 through a mixing element 6 having an inlet opening 2. As shown in FIG. 1, the suspension S1 may be mixed with a gas G, e.g., air, before entering flotation tank 1 and combining with suspension already within flotation tank 1. According to the present invention, entering suspension S1 may be routed through a guiding element 3 having an influx opening 4 that may be located a predetermined distance a (shown, e.g., in FIG. 2), e.g., less than approximately 1 m, away or apart from inlet opening 2 to form an intermediary space. Within flotation tank 1, the arrows S2 represent a portion of suspension within flotation tank 1 being drawn (or aspirated) into the intermediary space between inlet opening 2 and influx opening 4 due to the movement of suspension S1 through the intermediary space. The flow out of guiding element 3 may be regulated at a speed of, e.g., less than approximately 2 m/sec, and preferably less than approximately 1 m/sec. Mixing element 3 may have a length of, e.g., between approximately 0.1 and 1 m, and a cross-sectional flow area of, e.g., between approximately 0.001 and 0.05 $m^2$. Further, a mixing volume within the guiding element is at most 5% of a suspension volume in flotation tank 1. The intermediary space may function as a collecting chamber 7 (see FIG. 2). The suspension clarified through the flotation process may be discharged from flotation tank 1 through an outlet opening 5 as accepted stock A. Accepted stock A may be a fibrous suspension freed of foreign matter or may be clarified water from which as great as possible a percentage of all contained solids may have been removed by flotation.

FIG. 2 illustrates a more detailed view of guiding element 3 and mixing element 6. As noted above, collecting chamber 7 (indicated by dashed lines) may be located between inlet opening 2 and influx opening 4. When viewed in terms of flow direction, guiding element 3 may have a length c. In accordance with the present invention, collecting chamber 7 may also include an offset b between the center lines of openings 2 and 4. Offset b may be adjustable to enable regulation of a mixing effect. The adjustability of offset b may be particularly advantageous when adjusting of predetermined distance a may be difficult, e.g., due to structural limitations or parameters. An example of such a structural limitation may be illustrated by the radial flow routing of FIGS. 6 and 7 (discussed further below). Offset b may influence recirculation of the suspension already inside flotation tank 1. Offset b, located as shown in FIG. 2, for example, may encourage greater aspiration of the suspension from above guiding element 3. Further, a face of influx opening 4 may be, e.g., approximately 1.5 to 5 times larger than a face of inlet opening 2.

In the embodiment shown in FIG. 1, it is not necessary that inlet opening 2 be flush with the wall of flotation tank 1. In fact, the non-flush arrangement may provide several advantages during flotation. However, inlet opening 2 may be disposed in the tank wall, e.g., as shown in FIG. 3. In the exemplary embodiment shown in FIG. 3, a bubble-forming gas G may be pumped directly through the wall and into the suspension in flotation tank 1, instead of applying gas G to suspension S1 within mixing element 6. Further, this arrangement of directly pumping gas G into the flotation tank 1 may be utilized with other alternative dispositions and couplings of mixing element 6 to the wall of flotation tank 1. The volume of gas bubbles, to be utilized in the flotation process, present in the mixing element may be, e.g., less than approximately three times the suspension volume.

A mixing effect within flotation tank 1 may be determined by, e.g., the size of the distance a, i.e., of the intermediary space. This distance may also be utilized to determine a flotation effect. Thus, adjusting distance a may be absolutely utilized as a potential for controlling the flotation process. FIG. 4, for example, shows that guiding element 3 may be axially movable and adjustably coupled to inlet element 6 to vary distance a. This movement, e.g., may be carried out provided with a motor and the motor may function as an adjusting member of a control circuit (not shown). Other devices for adjusting guiding element 3 with respect to mixing element 6 are available and use the and implementation of these devices for use with the present invention would be familiar to those ordinarily skilled in the art.

Figure 5:
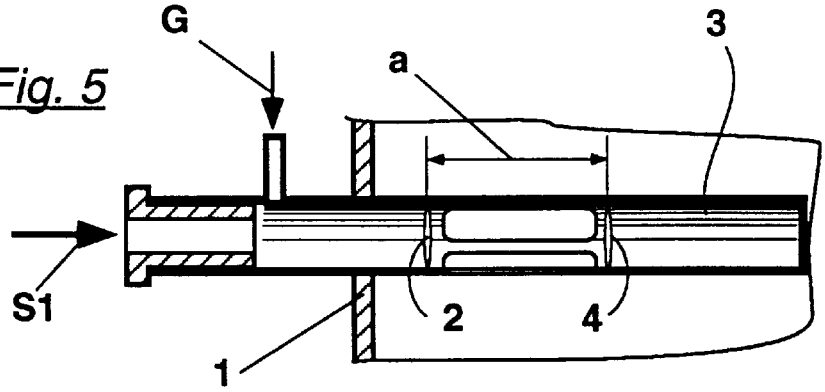
FIG. 5 schematically illustrates an alternative mixing device in accordance with the present invention.

FIG. 5 shows a more specifically arranged device for carrying out the process of the present invention. In this instance, e.g., guiding element 3 may be unitarily formed with mixing element 6. The intake (aspiration openings) for the suspension already located within flotation tank 1, which is similar in use to the above-described collecting chamber, may be formed by elongated openings located in the inlet element 6, upstream of guiding element 3, to be located within flotation tank 1. Thus, a space having a distance a may be formed between inlet opening 2 and influx opening 4, even when, as shown in FIG. 5, the openings are formed by ovals.

Figure 6:
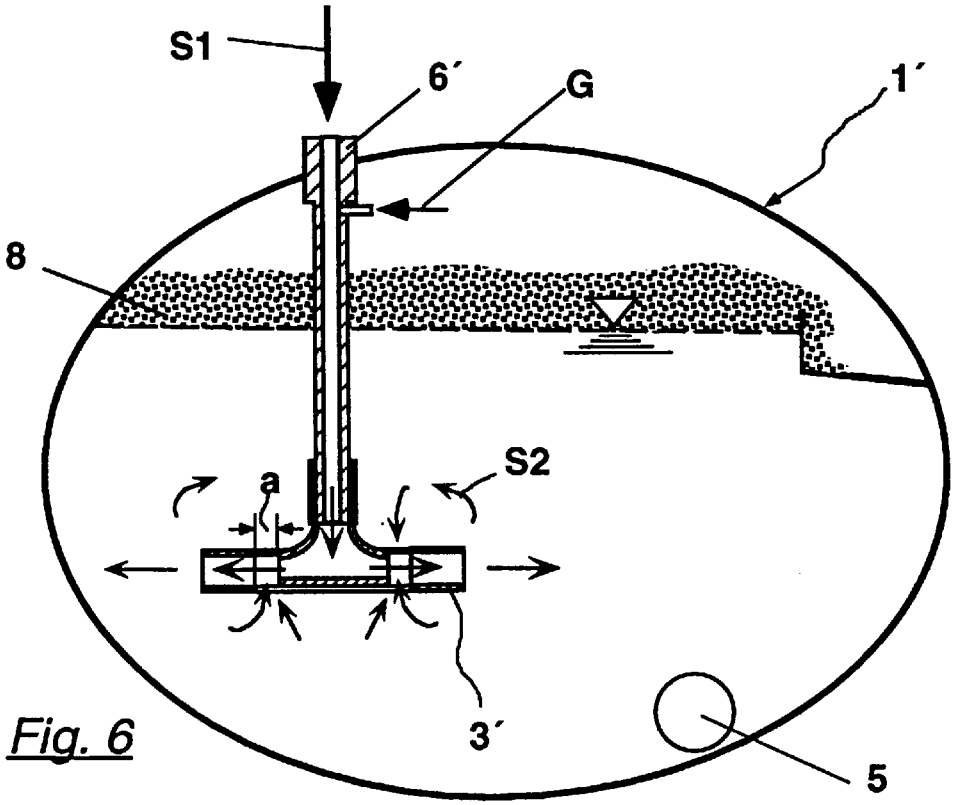
FIGS. 6, 7, and 8 schematically illustrate further alternative mixing devices in accordance with the present invention.

FIG. 6 illustrates a sectional view of a flotation tank 1' having a substantially oval cross section. As shown in the figure, suspension S1 may be delivered into flotation tank 1' and may be aerated by a mixing element 6', having a cylindrical inlet opening. Thus, suspension S1, which is to undergo flotation treatment, may flow down mixing element 6' and then flow radially outward, and into flotation tank 1'. This flow routing, which is known to the ordinarily skilled artisan, has considerable advantages in the context of flotation. Further, mixing element 6' may be advantageously coupled off-center with respect to flotation tank 1'. Thus, the process of the present invention may be performed utilizing this type of inverted "T" inlet element. However, to ensure the radial influx of suspension already in flotation tank 1', guiding element 3' should be substantially positioned around the inlet opening 21 in an annular shape while maintaining an appropriate distance a, as discussed above.

Figure 7:
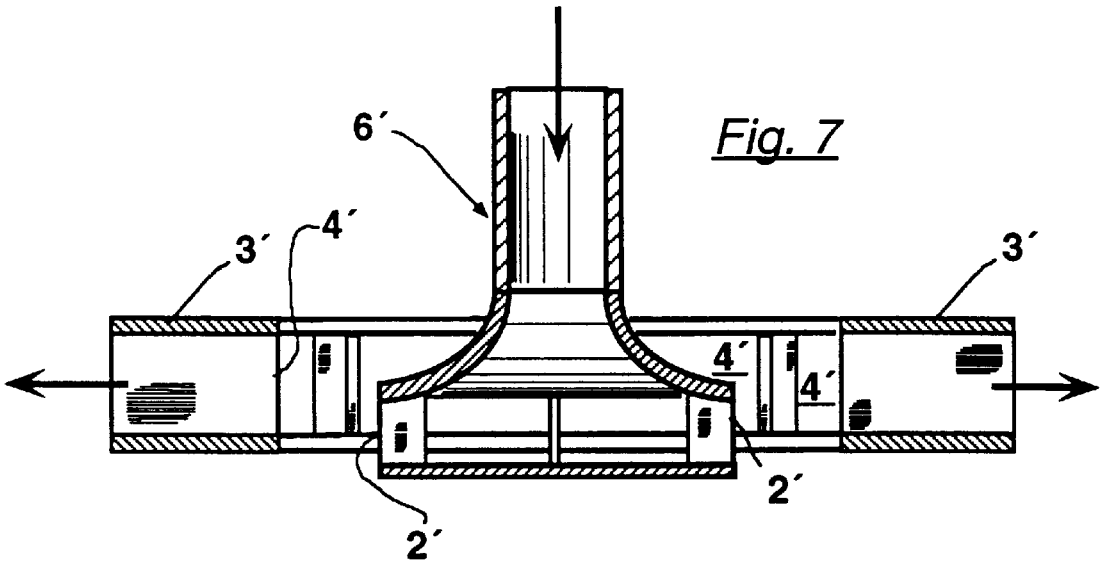

FIG. 7 illustrates a more detailed view of the arrangement of the mixing element 6' and the guiding element 3', in accordance with the present invention. Guiding element 3' may have a vertical offset with respect to inlet opening 2'. While the vertical offset feature is not necessary to practice the process of the present invention, this feature may be utilized for regulating mixing in the flotation tank, as discussed above. While the structural features for imparting the offsetting between inlet opening 2' and guiding element 3' are not shown in the drawings, implementation of such an arrangement is well within the purview of the ordinarily skilled artisan.

Figure 8:
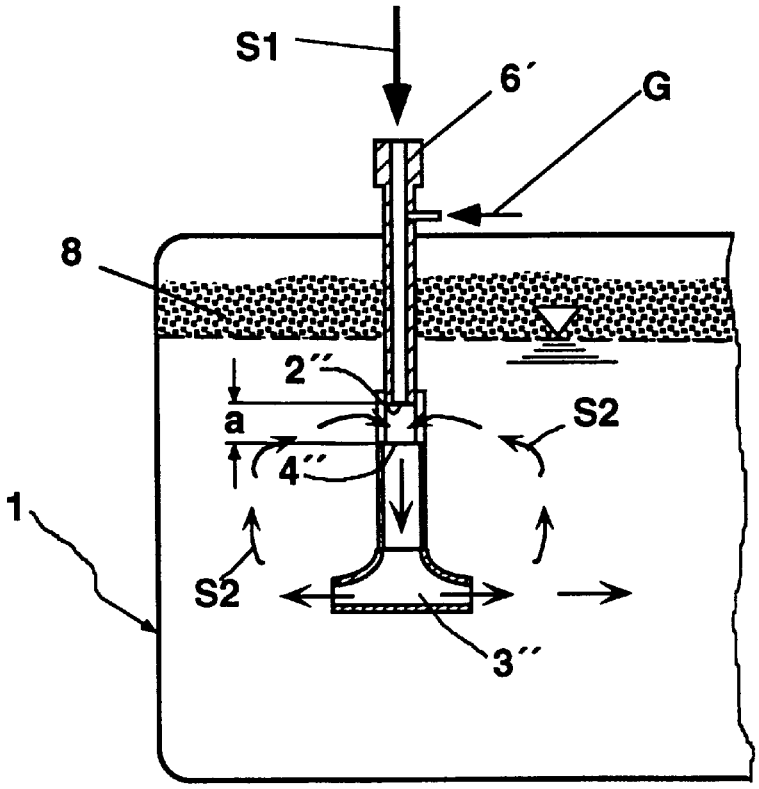

In another alternative embodiment, FIG. 8 shows another device arranged as an inverted "T" for practicing the present invention in which suspension S1 enters the flotation tank 1 in a vertical direction and is discharged or flows out from guiding element 3" in a radially outward direction, with respect to mixing element 6'. In the device shown in FIG. 8, suspension S1 may be vertically introduced into flotation tank 1 through mixing element 6'. Along a longitudinal extent of mixing element 6', an intermediary space may be formed between mixing opening 2" and influx opening 4" having a predetermined distance a. In contrast to the devices depicted in FIGS. 6 and 7, the direction of the flow of suspension S1 through inlet opening 2" and influx opening 4" may be substantially perpendicular to the flow direction of suspension S1 through guiding element 3". That is, suspension S1 may initially enter flotation tank 1 through mixing element 6' in a substantially vertical direction. However, at guiding element 3", located at an opposite end of a mixing element 6', suspension S1 may be diverted in a substantially horizontal and outward direction. Thus, a substantially circular flow S2 may be formed within the suspension in flotation tank 1 by suspension S1 flowing out of guiding element 3' and the suspension in the tank being drawn into the intermediary space. As with the previous embodiments, guiding element 3" may be adjustably positioned to move relative to a mixing element 6' to adjust the predetermined distance a for regulation and control of the flotation process, if so desired.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims. For example, the above-described facility may illustrate only one possible arrangement for performing the process of the present invention. However, the ordinarily skilled artisan, through the teachings of the present invention, may provide further devices and/or arrangements for carrying out the disclosed features and processes of the present invention.

What is claimed is:

1. A flotation process for separating ink from a paper fiber suspension containing ink within a flotation tank by flotation, the flotation producing clarified accepted paper fiber stock and a foam containing said ink collected on a surface of the suspension within the flotation tank, the flotation process comprising:

introducing a feed paper fiber suspension containing ink, which does not originate from inside of the flotation tank into the flotation tank, through an inlet opening;

aerating the feed suspension, which does not originate from inside of the flotation tank, prior to a guiding element;

guiding a portion of the aerated suspension from the inlet opening to the guiding element;

aspirating a portion of the suspension within the flotation tank;

drawing the aspirated portion into the guiding element;

mixing the guided portion with the aspirated portion within the guiding element; and collecting the foam containing said ink from the surface of the suspension in said flotation tank.

2. The flotation process according to claim 1, regulating a flow of the guided portion and the aspirated portion through the guiding element of less than approximately 2 m/sec.

3. The flotation process according to claim 2, regulating the flow through the guiding element of less than approximately 1 m/sec.

4. The flotation process according to claim 1, further comprising:

positioning the guiding element within the flotation tank; and spacing an influx opening of the guiding element a distance of less than approximately 1 m from the inlet opening.

5. The flotation process according to claim 1, further comprising:

maintaining a mixing volume within the guiding element less than approximately 5% of a suspension volume within the flotation tank.

6. The flotation process according to claim 1, further comprising adjustably spacing an influx opening of the guiding element from the inlet opening.

7. The flotation process according to claim 6, further comprising:

monitoring a flotation effect; and actuating the spacing adjustment in accordance with the monitored flotation effect.

8. The flotation process according to claim 1, further comprising laterally adjusting, with respect to a flow direction of the guided portion, the guiding element relative to the inlet opening.

9. The flotation process according to claim 8, further comprising:

monitoring a flotation effect; and actuating the lateral adjustment in accordance with the monitored flotation effect.

10. The flotation process according to claim 1, further comprising positioning the inlet opening for a horizontal flow of the feed suspension into the flotation tank.

11. The flotation process according to claim 1, further comprising positioning the inlet opening for a vertical flow of the feed suspension into the flotation tank.

12. The flotation process according to claim 11, further comprising deflecting the feed suspension in the guiding element to flow substantially horizontally outward.

13. The flotation process according to claim 11, further comprising deflecting the feed suspension to flow substantially horizontally outward through the inlet opening and through the guiding element.

14. The flotation process according to claim 1, further comprising adding gas bubbles to the feed suspension before the suspension emerges from the inlet opening.

15. The flotation process according to claim 1, further comprising adding gas bubbles for flotation to the feed suspension, at least partially, in the guiding element.

16. The flotation process according to claim 1, further comprising adding gas bubbles for flotation, at least in part, directly in the flotation tank.

17. The flotation process according to claim 1, further comprising:

introducing a gas to the feed suspension before introducing the suspension to the flotation tank;

exerting a pressure on the suspension with the gas;

dissolving the gas in the suspension;

reducing the pressure on the suspension; and producing gas bubbles for flotation through the suspension.

18. The flotation process according to claim 1, further comprising providing a volume of gas bubbles for flotation in the guiding element of less than approximately three times a suspension volume in the guiding element.

19. A flotation process in a flotation tank in a paper fiber suspension containing ink is separated into a clarified accepted paper fiber stock and a foam containing said ink formed on a surface of a suspension in the flotation tank, the flotation process comprising:

guiding an input feed paper suspension containing ink, which does not originate from inside of the flotation tank, from a mixing element, through a predefined space, and to the guiding element;

aerating the input suspension, which does not originate from inside of the flotation tank prior to entering the the predefined space;

drawing a portion of the suspension in the flotation tank into the predefined space; and mixing the aerated input suspension and the drawn in suspension; and collecting the foam containing the ink from the surface of the suspension in the flotation tank.

20. The flotation process according to claim 19, further comprising creating a circular flow pattern within the suspension in the flotation tank.

21. The flotation process according to claim 19, further comprising:

guiding the input suspension in a substantially horizontal direction, with respect to the flotation tank; and expelling the mixed input suspension and drawn in suspension in the substantially horizontal direction.

22. The flotation process according to claim 19, further comprising:

guiding the input suspension in a substantially vertical direction, with respect to the flotation tank; and expelling the mixed input suspension and drawn in suspension in a substantially horizontal direction.

23. The flotation process according to claim 22, further comprising:

drawing the drawn in suspension into the substantially vertically guided input suspension.

24. The flotation process according to claim 22, further comprising:

deflecting the guided input suspension from the substantially vertical direction to a substantially horizontal direction; and drawing the drawn in suspension into the substantially horizontally guided input suspension.

25. A flotation process for separating ink from a fibrous paper suspension containing said ink within a flotation tank to produce purified accepted fibrous paper stock and a foam containing said ink collected on a surface of the suspension within the flotation tank, the process comprising:

aerating a fibrous feed paper suspension containing said ink via a mixing device;

introducing the feed suspension into the flotation tank through an inlet opening;

guiding at least a portion of the aerated suspension to a guiding element located within the flotation tank;

aspirating a portion of the suspension within the flotation tank;

drawing the aspirated portion into the guiding element; and mixing the guided portion with the aspirated portion within the guiding element; and collecting the foam containing the ink from the surface of the suspension in the tank.

26. The process in accordance with claim 25, wherein the feed suspension is aerated prior to entering the flotation tank.

27. The process in accordance with claim 25, wherein the feed suspension is aerated after entering the flotation tank.

28. The process in accordance with claim 25, wherein the feed suspension introduced through the inlet opening is an aerated suspension.

* * * * *